United States Patent [19]

Motizuki

[11] 4,263,799

[45] Apr. 28, 1981

[54] METHOD AND MACHINE FOR FORMING A LUMP ON THE END OF A PIPE

[76] Inventor: Torazi Motizuki, 23-12, Nishikohjiya-4, Ohta-ku, Tokyo-to, Japan

[21] Appl. No.: 58,950

[22] Filed: Jul. 19, 1979

[51] Int. Cl.[3] ..... B21K 1/22

[52] U.S. Cl. ..... 72/318; 72/342; 72/367; 29/156.7 C

[58] Field of Search ..... 72/318, 342, 367; 29/156.5 C, 156.5 R; 219/101, 103, 104, 107, 59.1, 7.5, 8.5

[56] References Cited

U.S. PATENT DOCUMENTS

| | | | |
|---|---|---|---|
| 1,592,275 | 7/1926 | Guerne | 29/156.7 R |
| 1,772,444 | 8/1930 | Giacchino | 29/156.7 R |
| 2,093,776 | 9/1937 | Colwell | 29/156.7 C |
| 2,325,522 | 7/1943 | Lauer et al. | 72/318 |
| 2,440,461 | 4/1948 | Clements | 219/107 |
| 2,495,060 | 1/1950 | Hanna | 72/342 |
| 3,793,873 | 2/1974 | Iwata et al. | 29/156.7 C |
| 3,842,644 | 10/1974 | Biesmans | 72/342 |

FOREIGN PATENT DOCUMENTS

| | | | |
|---|---|---|---|
| 450173 | 7/1948 | Canada | 29/156.7 C |
| 457306 | 6/1949 | Canada | 29/156.7 C |

*Primary Examiner*—Daniel C. Crane
*Attorney, Agent, or Firm*—Michael A. Painter

[57] ABSTRACT

First a metallic pipe is tapered, so that it is substantially closed at its end, and so that its cross-section is reduced. Then it is pressed hard against a mold electrode, and a large electric current is passed through it to the mold electrode, so that the end softens, but does not melt, and by the pressing (which may be of the order of 2.5 tons weight) the end is formed into a lump, with no trace remaining of the hole through the pipe within the lump. In certain embodiments, the mold electrode may be formed with a notch, and/or a depression, and may be inclined at an oblique angle to the axis of the pipe, and may be moved sideways or at an oblique angle to the axis of the pipe as the current is passed and the lump formed.

11 Claims, 10 Drawing Figures

METHOD AND MACHINE FOR FORMING A LUMP ON THE END OF A PIPE

BACKGROUND OF THE INVENTION

The present invention relates to metal forming, and more particularly relates to forming a lump on the end of a metal pipe.

It is often required to form a part for a machine of the general form of a lump on the end of a rod. Nowadays it is becoming more and more common to use a hollow pipe instead of a solid bar. Conventionally, it has been practiced to form such a lump on the end of a pipe by making the lump separately and then attaching it to the end of the pipe by welding, melting together, or physical fastening such as screwing, interference-fitting or the like.

However, not only does this involve considerable labor, and considerable loss of working metal, but the final result is often of doubtful strength, since there is uncertainty as to the continuity of the connection.

Direct working of the end of the pipe by forging has been practiced; but this requires the end to be formed as a rough lump shape in advance.

SUMMARY OF THE INVENTION

As a process for heating up the end of a metallic pipe, one efficient way is to pass a large current through the pipe while it is pressed against a base such as a mold electrode. The end of the pipe then softens, and both the inner diameter decreases and the outer diameter increases. However, as the inner diameter decreases, the metal on the inner surface may form oxide films, and the inner diameter may not decrease to zero. Therefore the disappearance of the hole through the pipe cannot be relied upon, unless the pipe end is completely melted.

Melting of the end of the pipe is not desirable, because it may well cause metallographical changes, in which the structure of the metal changes, although of course not its composition.

It is therefore an object of the present invention to form a lump on the end of a metallic pipe, which is free of any inclusions or cavities therein which may remain from the hole in the pipe, and which is continuous with the metal of the pipe itself, without melting the metal of the pipe.

It is further another object of the present invention to provide a machine which can perform the above process. It is also an object of the present invention to provide a pipe with a lump formed on the end thereof in accordance with the above process.

According to the present invention, these and other objects are accomplished by a method of forming a lump on one end of a metallic hollow pipe, comprising, in the specified order, the steps of: (a) constricting the end of the pipe, so that it is substantially closed, and so that the metal cross-sectional area of the constricted portion is less than that of the unconstricted portion; and (b) pushing the constricted end against a mold electrode while passing electrical current through the pipe to the electrode, the current flow heating the end and softening it, while the pushing deforms it; and by a machine for forming a lump on one end of a metallic hollow pipe, comprising: a means for constricting the end of the pipe, so that it is substantially closed, and so that its metal cross-sectional area is less than it was; an electric source; a mold electrode adapted to be connected to the electric source; a pipe electrode adapted to be connected to the electric source, and adapted to be connected electrically to the pipe; and a means for pushing the pipe so that its end abuts against the mold electrode.

BRIEF DESCRIPTION OF THE DRAWINGS

The present invention will now be described with reference to some particular embodiments thereof, and with reference to the accompanying drawings, which, however, are not intended to be limitative of the present invention, and wherein.

DESCRIPTION OF THE PREFERRED EMBODIMENTS

Figure 1:
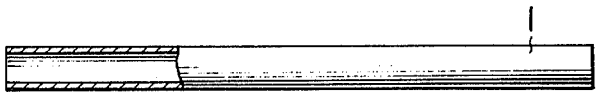
FIG. 1 shows a metallic pipe before it is worked, in partial section.
Figure 2:
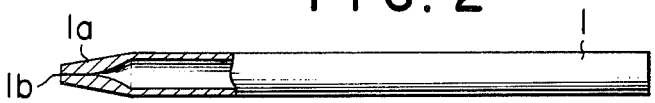
FIG. 2 shows the pipe with the left hand end constricted, again in partial section.

The pipe diagrammatically illustrated in FIG. 1 is a pipe at the end of which it is desired to form a lump. First the left hand end of this pipe is tapered and virtually closed, by a means of a conventional sort which is not shown in the figures, by swaging, forging, roll-forming, or the like. Thus, in section, the end of the pipe is as shown in FIG. 2.

Figure 3:
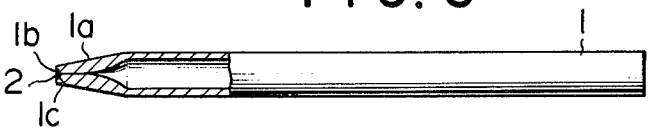
FIGS. 3 and 4 show, in the same way, the pipe with the end positively blocked in two alternative ways.
Figure 4:
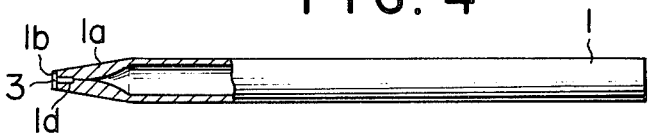

Then, in certain applications, if it is desired more positively to ensure the closure of the end, either a depression 1*c* may be formed on the end surface 1*b* of the pipe end 1*a*, and filled with molten metal 2—as illustrated in FIG. 3; or, alternatively, an axially extending hole 1*d* having a smaller diameter than the end surface 1*b* may be bored in the end 1*a* of the pipe, and plugged up with a plug 3, as illustrated in FIG. 4.

According to the present invention, and as a matter of general course, the cross-sectional area of the end portion 1*a* of the pipe 1 becomes less than it was, and thus less than the cross-sectional area of the undeformed section of the pipe.

Figure 5:
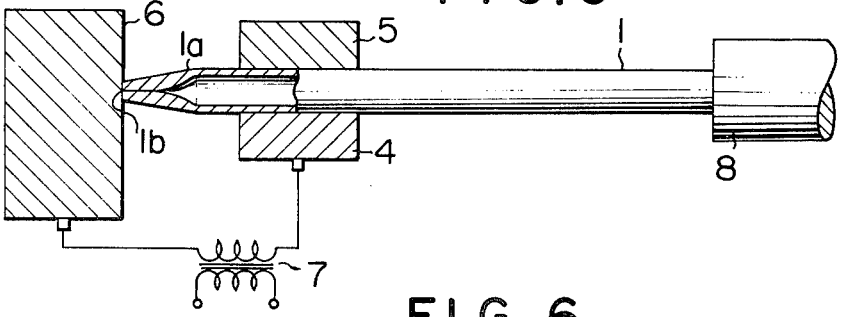
FIG. 5 shows the pipe as held against a mold electrode, before electric current is passed, according to a first embodiment of the present invention.

Next, the pipe is held with its constricted end against a mold electrode 6, as shown in FIG. 5, and a slider electrode 4 is contacted to one side of it and a clamp member 5 is pressed against the other side of it, so as to ensure good contact. Further, a pushing member 8 presses the pipe hard against the mold electrode 6. Then a high electric current is passed from an electric source 7 through the left hand portion of the pipe, between the mold electrode 6 and the slider electrode 4.

The slider electrode 4 and clamp member 5 may preferably be made of chrome copper, while the mold electrode 6 may preferably be made of molybdenum. The electric source 7 may preferably be a low voltage high current winding of a transformer.

Figure 6:
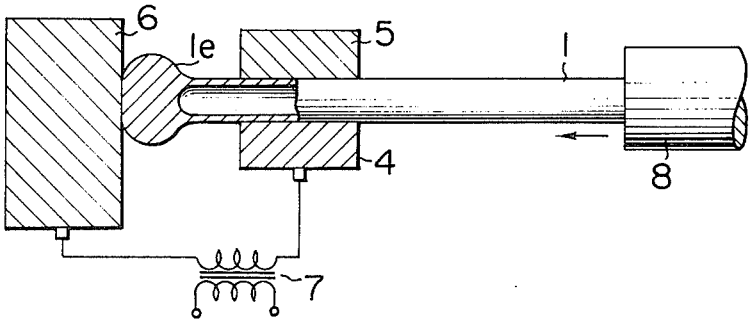
FIG. 6 shows the operation of this embodiment, while current is being passed and the end of the pipe softened, and during the formation of a lump on the end of the pipe.

The passing of the high electric current heats up the end of the pipe 1*a* more than the other parts, because it has a smaller metal cross-section. Soon the end 1*a* is heated so much that it begins to soften. As this happens, the end expands radially so as to form a concentric lump 1*e*, as shown in FIG. 6, because of the pushing of the pushing member 8.

The shape of this lump may be controlled to a certain extent by adjusting the relation between the current passed, which determines the rate of heat generation in the end of the pipe, and the force of pushing exerted by the member 8. That is, when the force of pushing is high compared with the current, the axial dimension of the lump is small compared with its radial dimension, so that it bulges greatly; and, conversely, when the force of pushing is low compared with the current, the axial dimension of the lump is large compared with its radial dimension, so that it only bulges a little.

Of course, because of the softening of the metal, the inner walls of the pipe join together at the end 1*a*, and no discontinuity exists within the lump. Further, by proper management of the force and the current, the thickness of the lump may be arranged to increase smoothly, giving a final product with very good strength and few interior faults.

When a lump of desired size and form is attained, the pipe 1 may be removed from the machine, and the end 1*e* may be formed by forging or press-forming in another mold, while it is soft. It is to be noted that no material loss has occurred.

If it is desired to form the lump as extending in one particular direction away from the pipe, it is necessary to move the mold electrode sideways while the pipe is being pressed against it. No figure is shown for this, but it may be easily imagined, based on the foregoing disclosure.

Particular parameters of an embodiment of the method of the present invention are as follows:

Pipe material: JIS-G-3445-1996-STKM-16 (C: 0.35 -0.45%; Si: 0.4% or less; Mn: 0.4 -1%; P: 0.04% or less; S: 0.04% or less; and balance Fe)
Pipe outer diameter: 13 mm
Pipe wall thickness: 2.3 mm
Length of tapered part: 35 mm
current: 8000 amps; pressing force: 2.5 tons weight
temperature of softened portion: 1050° C. approximately maximum diameter of lump: 23 mm
maximum length of lump: 45 mm
time required: approximately 15 seconds As a second preferred embodiment of the present invention, a lump may be formed which extends sideways at a certain non-right angle to the axis of the pipe. This is illustrated in FIGS. 7 and 8, wherein similar numerals denote similar parts to those in FIGS. 1-6.

In this embodiment, the mold electrode, herein designated by 9, is held at an oblique angle to the axis of the pipe, and is moved in this direction. Thus the lump, as it is being formed, is led in an oblique angle away from the pipe, as may be seen in FIG. 8.

Figure 7:
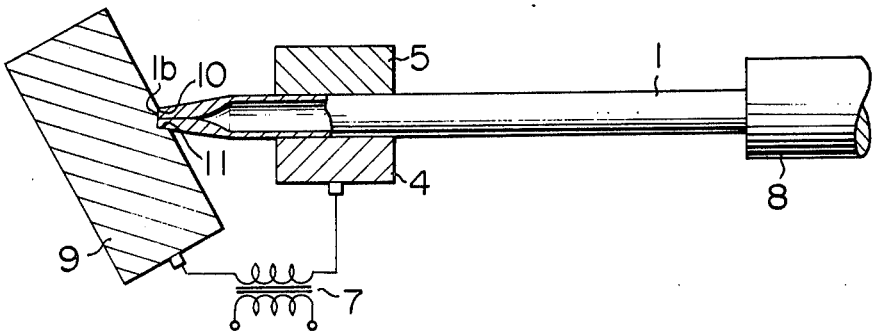
FIGS. 7 and 8 show an alternative embodiment, in a similar way to FIGS. 5 and 6, wherein the mold electrode is tilted, and formed with a notch therein.
Figure 8:
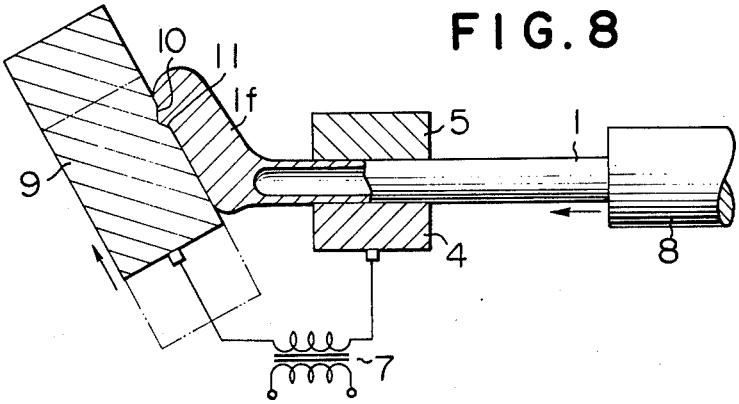

Further, according to a particular feature of the present invention, in the illustrated embodiment, a notch is formed in the surface of the mold electrode 9, so shaped that when the pipe 1 is initially contacted to the mold electrode 9, before any current is passed, the end 1*a* of the pipe 1 fits snugly into the notch, the bottom of the notch mating snugly therewith, so that good contact is formed between the confronting face 10 of the notch and the end 1*b* of the pipe 1, as may be seen in FIG. 7. The other surface 11 of the notch is angled at more than 90° to the face 10, so that it does not contact the pipe end 1*a*. Thereby good heating can be commenced. If this notch is not provided, difficulty may be found in commencing the process of the present invention. Local heating only may occur at the rather small contact surface of the pipe and the mold surface, and this may cause melting rather than softening of the entire pipe end, as desired.

Figure 9:
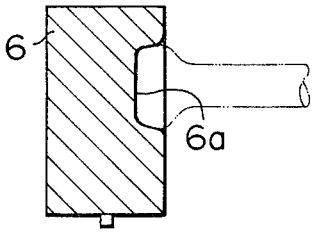
FIGS. 9 and 10 show an alternative form for the mold electrode, wherein it is formed with a depression.
Figure 10:
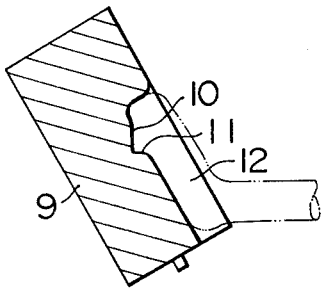

As another possible embodiment of the present invention, the mold electrode may be formed with a depression therein, as shown in FIGS. 9 and 10, so that the sides of the lump may be shaped in some particular desired way. This modification may be applied to either the first described embodiment or the second.

Although the present invention has been shown and described with reference to several preferred embodiments, it should not be considered as being limited to these, however, or mere and simple generalizations, or other detailed embodiments. Yet further changes and modifications may be made in the form and the content of the present invention without departing from its scope or spirit. Therefore it is desired that the present invention should be defined and protection should be afforded, not by any of the purely fortuitous details of the shown embodiments, or of the drawings, but solely by the accompanying claims.

I claim:

1. A method of forming a lump on one end of a metallic hollow pipe, comprising, in the specified order, the steps of:

(a) constricting the end of the pipe so that it is substantially closed, and whereby the metal cross-sectional area of the constricted portion is less than that of the unconstricted portion; and (b) pushing the constricted end against a mold electrode while passing electrical current through the pipe to the electrode, the current flow heating the end and softening it, while the pushing deforms it and moving said mold electrode relative to the pipe in a direction at an angle to the axis of the pipe.

2. A method as defined in claim 1 wherein the mold electrode is formed with a depression therein into which the pipe is pushed during step (b) whereby the depression molds the end of the pipe into a desired shape.

3. A method as defined in claim 1 wherein between steps (a) and (b), said method further comprising the steps of drilling a hole into the substantially closed end of the pipe and inserting a metallic plug thereinto.

4. A method as defined in claim 1 wherein between steps (a) and (b), said method further comprising the steps of forming a depression in the substantially closed end of the pipe and filling said depression with molten metal.

5. A method as defined in claim 1 wherein the direction of motion of the mold electrode is non-perpendicular to the axis of the pipe, and further comprising the step of forming a notch in the mold electrode which receives the end of the pipe at the start of step (b), the bottom of the notch mating snugly with the pipe end at that time and ensuring good electrical contact between the pipe end and the mold electrode.

6. A method as defined in claim 5 further comprising the steps of providing a mold electrode formed with a depression therein, containing the notch, into which the pipe is pushed during step (b), so that the depression molds the end of the pipe into a desired shape.

7. A machine for forming a lump on one end of a metallic hollow pipe which is substantially closed and has a cross-sectional area less than that of the remaining portion of the pipe, comprising:

(a) an electric source;

(b) a mold electrode adapted to be connected to the electrical source;

(c) a pipe electrode having means for holding a pipe and adapted to be connected to the electric source, and adapted to be connected electrically to the pipe;

(d) means for moving said pipe along its axis whereby a pipe end is pushed against the mold electrode; and (e) means for moving said mold electrode relative to the pipe in a direction at an angle to the axis of the pipe.

8. A machine as defined in claim 7 wherein the means for pushing the pipe is capable of exerting a force of at least 2.5 tons weight.

9. A machine as defined in claim 7, wherein the mold electrode is formed with a depression therein.

10. A machine as defined in claim 7 wherein the mold electrode is disposed at an oblique angle to the axis of the pipe when the pipe is pushed by the pushing means.

11. A machine as defined in claim 10 wherein the mold electrode is formed with a notch therein.

* * * * *